United States Patent [19]

Hallberg

[11] 4,284,588

[45] Aug. 18, 1981

[54] FUEL SYSTEM

[75] Inventor: Irving H. Hallberg, Des Plaines, Ill.

[73] Assignee: Borg-Warner Corporation, Chicago, Ill.

[21] Appl. No.: 23,378

[22] Filed: Mar. 23, 1979

[51] Int. Cl.[3] ..... F02M 7/12; F02M 37/00

[52] U.S. Cl. ..... 261/36 A; 123/462; 261/34 B

[58] Field of Search ..... 261/36 A, 39 B, 39 A, 261/34 B; 123/139 AW, 119 R, 119 EC, 455, 462, 530

[56] References Cited

U.S. PATENT DOCUMENTS

| | | | |
|---|---|---|---|
| 3,785,627 | 1/1974 | Tuzson et al. | 261/36 A |
| 3,927,382 | 8/1976 | Tuzson et al. | 123/139 AW |
| 4,018,856 | 4/1977 | Hamakawa | 261/34 B X |
| 4,130,610 | 12/1978 | Paul | 261/36 A |
| 4,152,376 | 5/1979 | Tuzson | 261/36 A |
| 4,155,336 | 5/1979 | Hallberg | 261/36 A X |

FOREIGN PATENT DOCUMENTS

| | | | |
|---|---|---|---|
| 458659 | 12/1936 | United Kingdom | 261/36 A |

*Primary Examiner*—Stuart S. Levy
*Attorney, Agent, or Firm*—Aubrey L. Burgess

[57] ABSTRACT

A fuel system in which excess fuel is recirculated from the charge forming apparatus. The apparatus comprises a regulator having a body with a fuel supply port connected to a fuel source, an outlet port for supplying fuel to a zone and a return port for receiving excess fuel from the outlet port and recirculating the excess fuel to the fuel supply. In addition, the apparatus may comprise temperature responsive means to vary the size of the return port to vary the quantity of excess fuel recirculated and thus the quantity of fuel supplied to the zone.

4 Claims, 4 Drawing Figures

FUEL SYSTEM

BACKGROUND OF THE INVENTION

For starting and warm-up of an internal combustion engine, the quantity of fuel in the fuel-air mixture supplied to the engine is generally increased. Usually, this is accomplished by restricting the amount of air to the carburetor, so that the resultant mixture is fuel enriched.

THE INVENTION

According to this invention, there is provided a structure for supplying a fuel enriched fuel-air mixture to an internal combustion engine to aid cold starting and warm-up of the engine. The carburetor to be described is of the fluid jet variety wherein fluid is delivered to a regulator which comprises a body having an inlet port connected to a fuel source, an outlet port from which fuel is supplied to the engine, and a return port for excess fuel which is returned to the source. Fuel is stripped from the outlet port by the air flowing thereacross and flows to the engine. Means are provided to restrict the return port which causes more fuel to be discharged from the outlet port thus enriching the fuel-air ratio, the restricting means being controlled manually or by a temperature responsive means so constructed and arranged to cause the restrictions of the return outlet. More specifically, the restricting means comprises a rotatable sleeve disposed around the regulator body with one or more ports, the positions of which are varied with respect to the return outlet depending on the temperature of the engine. In the temperature responsive embodiment, a bi-metal element is connected to the rotatable sleeve at one end and to the exhaust manifold at the other end and determines the relative positions of the sleeve ports and the return outlet according to the rise in temperature of the exhaust manifold.

THE DRAWINGS

DETAILED DESCRIPTION

Figure 1:
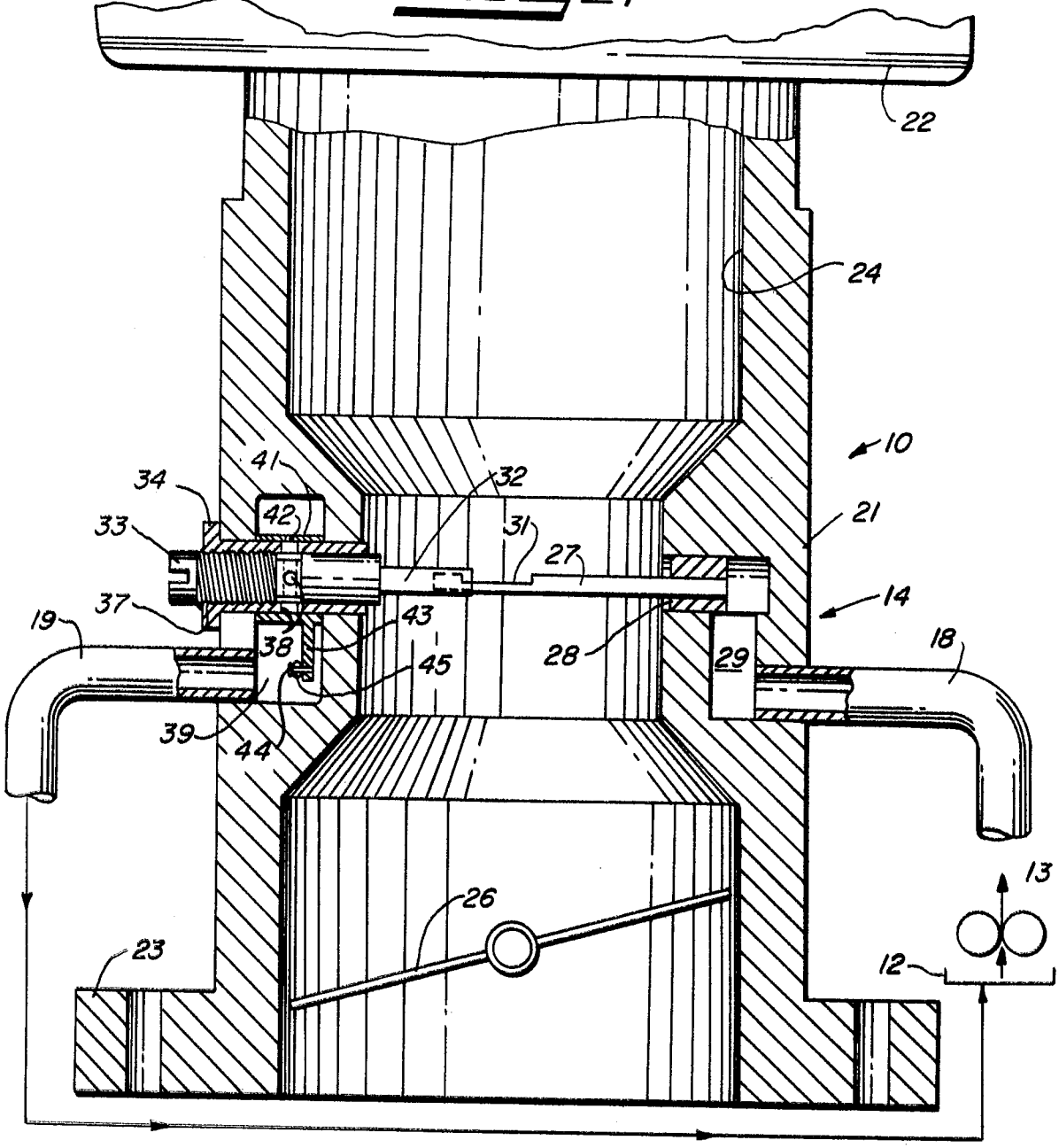
FIG. 1 is a longitudinal sectional view of a fuel system according to this invention.
Figure 2:
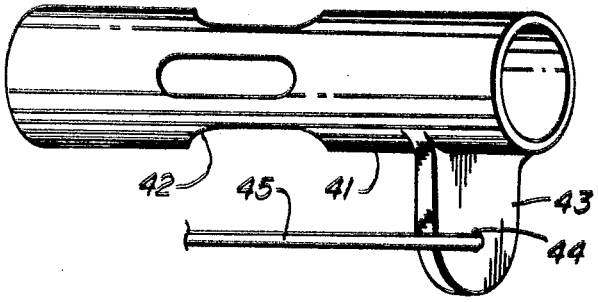
FIG. 2 is a pictorial view of the rotatable sleeve usable in either of the embodiments of FIGS. 1 and 3.

FIGS. 1 and 2 to which attention is invited, illustrate a fuel system 10 according to this invention which comprises a fuel tank 12, a pump 13, and charge forming apparatus 14 together with connecting conduits 18 and 19 arranged for supplying and recirculating fuel from the tank 12 to the charge forming apparatus 14 and recirculating excess fuel from the apparatus 14 to the tank 12. The fuel tank 12, pump 13 and conduits 18 and 19 may be of conventional construction.

The charge forming apparatus 14 comprises a body 21 having an air cleaner 22 mounted on one end and having a mounting flange 23 for mounting the structure on the inlet manifold of an internal combustion engine. An air inlet passage 24 extends through the body 21. A rotatable throttle plate 26 is mounted in the air inlet passage 24 for controlling air flow through the charge forming apparatus. A hollow tube 27 is mounted in a fitting 28 to recieve fuel from a cavity 29 formed in the body 21. The cavity 29 is connected to the conduit 18 and the pump 13 which pumps fuel from the fuel tank 12 to the cavity 29. The tube 27 extends across the air passage 24 and includes an opening 31 facing upstream, so as to receive the impact of air flowing in the air passage. A second tube 32 receives the tube 27 and is adjustably mounted in a fitting 33, 34 for adjustably masking a portion of the opening 31. The fitting 33, 34 is provided with a seal ring as desired, threads 37 and apertures 38. The threads 37 provide means for adjusting the size of the opening 31 while the apertures 38 provide for conducting excess fuel from the tube 27 to a cavity 39 formed in the body 21, the cavity 39 being connected to the fuel tank 12 by the conduit 19.

Surrounding the fitting 33, 34 is rotatable sleeve 41 having a plurality of openings 42 generally corresponding to the size and spacing of the apertures 38 in the fitting 33, 34 and an ear 43 is connected to the sleeve 41 for connection at pivot 44, by means of a link or cable 45, to operating means as will be described. A sleeve bearing may be interpositioned between the fitting and the sleeve, as is required.

Figure 3:
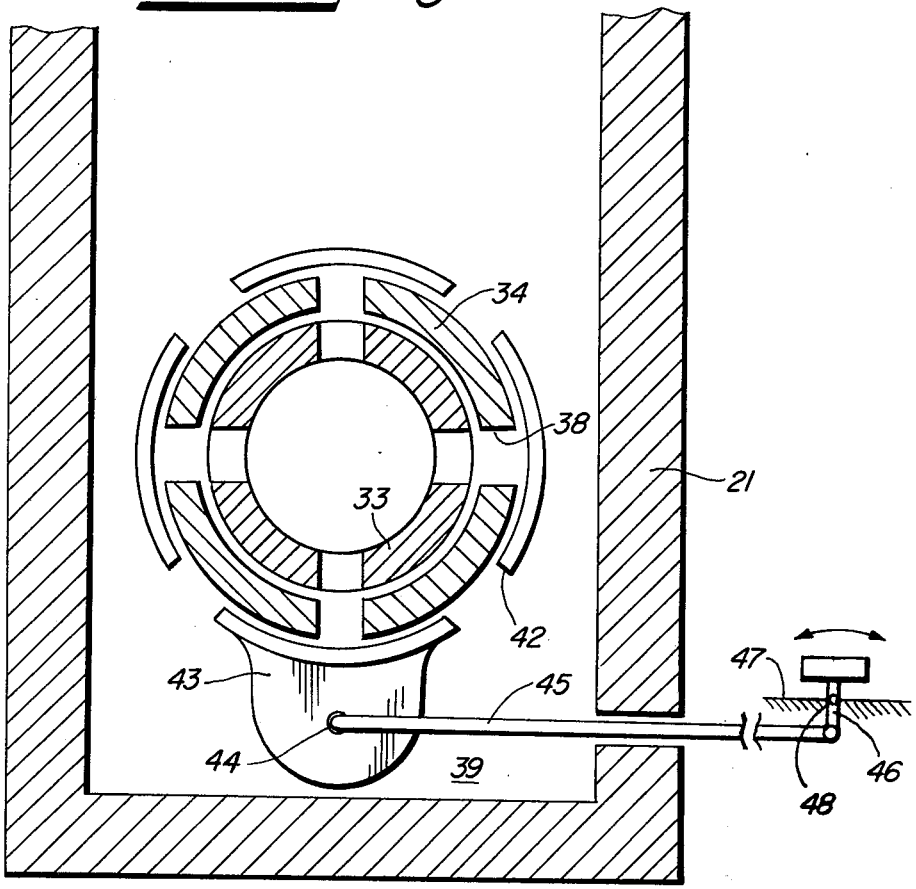
FIG. 3 is a sectional view through a manual fuel system according to another embodiment of this invention.

The operating means illustrated in FIG. 3 comprises a manually operated choke 46 as generally mounted on the dashboard 47 of a vehicle by a pivot 48. Movement of the choke rotates the sleeve 41 relative to the fitting 33, 34.

Figure 4:
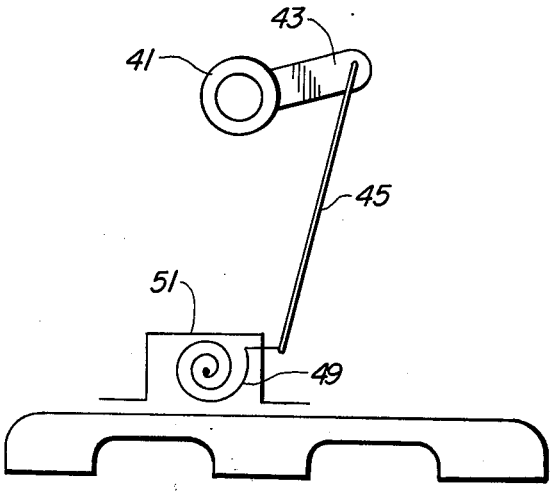
FIG. 4 is a partial sectional view through a temperature responsive fuel system according to the invention herein described.

FIG. 4 is another form of operating means; a bi-metal element 49 is connected at one end to the link 45 and is fastened at the other end to a housing 51 which in turn is mounted on the exhaust manifold of the vehicle. The rotation of the sleeve 41 is thus temperature controlled and temperature responsive.

In the invention just described, means are provided for enriching the fuel supply to an engine to aid in cold starting. This is accomplished by providing a control in the return fuel outlet of the receiver tube in a fluid jet carburetor. When the engine is cold, the sleeve 41 is positioned so that the apertures 38 are blocked or restricted, thus providing a back pressure on the return or excess fuel and permitting an increase in fuel stripped from the opening 31 by the air flowing thereacross. Generally, a complete restriction of the apertures 38 is not required. In the FIG. 3 embodiment, the restriction is manually controlled; in the FIG. 4 embodiment, as the engine warms up, the bi-metal element 49 causes the sleeve 41 to rotate until the openings 42 align with the apertures 38. At this time the fuel path is unrestricted and normal fuel metering occurs.

I claim:

1. In a fuel system having a fuel source and a charge forming apparatus arranged for recirculating excess fuel, a regulator outlet port exposed to an air stream which strips fuel therefrom and a spaced return port for receiving excess fuel from said outlet port, said return port being in a location removed from said air stream, characterized by means to vary the effective size of said return port to vary the quantity of excess fuel recirculated and thus the amount of fuel to said outlet port which varies the fuel-air ratio delivered by the system, which means to vary the effective size of said return port comprises:

a rotatable sleeve surrounding said body having an opening corresponding generally in size to said return port, and means to rotate said sleeve and the relative position of said opening with respect to said return port to thus vary the effective size of said return port.

2. In a fuel system as recited in claim 1 in which said fuel system is associated with a vehicle having a choke and wherein said means to rotate said sleeve comprises a shaft connected to said sleeve and said choke.

3. In a fuel system as recited in claim 1 wherein said means to rotate said sleeve comprises a temperature responsive means connected to said sleeve and to a source of varying temperatures and adapted to rotate said sleeve in responsive to temperature changes at said source.

4. In a fuel system as recited in claim 3 wherein said temperature responsive means comprises a bi-metal member.

* * * * *